219-121
6/24/76 XR 3,975,986

United States Patent [19]
Barth et al.
[11] 3,975,986
[45] Aug. 24, 1976

[54] WEEP HOLE FOR HYDRAULIC JACK

[75] Inventors: Benedict G. Barth, Kenosha, Wis.; Earl G. Willette, Jackson, Mich.; John M. Barosko, Kenosha, Wis.

[73] Assignee: Tenneco Inc., Racine, Wis.

[22] Filed: Feb. 3, 1975

[21] Appl. No.: 546,237

[52] U.S. Cl. ..... 91/402; 92/142; 219/121 LM; 92/249

[51] Int. Cl.[2] ..... F15B 15/22; F01B 31/20

[58] Field of Search ..... 92/142; 91/402, 325; 219/121 LM, 89, 121 L

[56] References Cited

UNITED STATES PATENTS

| | | | |
|---|---|---|---|
| 1,876,024 | 9/1932 | Rosenberry | 91/402 |
| 2,835,541 | 5/1958 | Rhoads | 92/142 |
| 3,265,855 | 8/1966 | Norton | 219/121 LM |
| 3,401,604 | 9/1968 | Blatt et al. | 91/402 |
| 3,538,294 | 11/1970 | Dicks et al. | 219/89 |
| 3,601,011 | 8/1971 | Arnes | 92/142 |
| 3,818,805 | 6/1974 | Johansson | 91/402 |

FOREIGN PATENTS OR APPLICATIONS

| | | | |
|---|---|---|---|
| 774,470 | 5/1957 | United Kingdom | 91/402 |

*Primary Examiner*—Paul E. Maslousky
*Attorney, Agent, or Firm*—Harness, Dickey & Pierce

[57] ABSTRACT

A laser formed hole is used as a "weep" hole in a hydraulic jack to limit the power stroke of the ram thereby permitting the use of a urethane packing on the ram instead of the usual leather packing.

3 Claims, 6 Drawing Figures

WEEP HOLE FOR HYDRAULIC JACK

BRIEF SUMMARY OF THE INVENTION

It is the purpose of this invention to improve the manufacture and structure of a hydraulic ram device by providing an improved type of "weep" hole for connecting the pressure side of the ram to the reservoir and an improved type of packing for the ram.

The invention accomplishes this purpose by means of a laser formed weep hole passage in the ram cylinder in which the direction of the laser beam is from the outside to the inside. The opening of the passage thus formed into the ram cylinder has a smooth, rounded edge. In operation of a hydraulic device, high pressure extrudes the flexible, soft, non-metallic ram packing into the weep hole. Heretofore, the weep hole is drilled and has a sharp edge that rapidly cuts away the soft packing material and to give as long a packing life as practicable it has been the practice to use leather as a packing. In contrast, the smooth, rounded edge of the laser formed hole of the invention does not appreciably dig into or cut the packing. It, therefore, for the first time, makes it feasible to use a urethane cup packing which is better and more economical than leather and eliminates a nut, a washer, and a threading operation on the end of the ram.

DETAILED DESCRIPTION OF THE INVENTION

Figure 2:
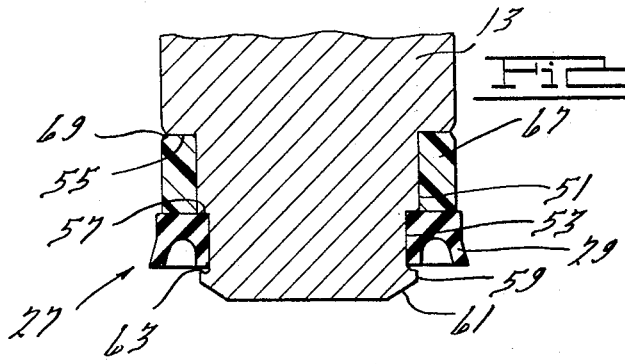
FIG. 2 is an enlarged cross section of the bottom end of the ram and shows the mounting of the urethane packing on the ram.
Figure 3:
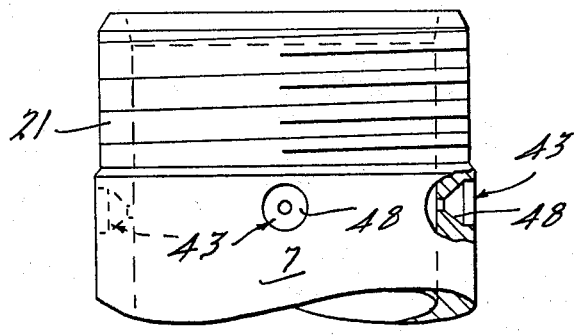
FIG. 3 is an enlarged side elevation of the upper end of the ram cylinder used in the jack of FIG. 1 showing the laser hole in section.
Figure 1:
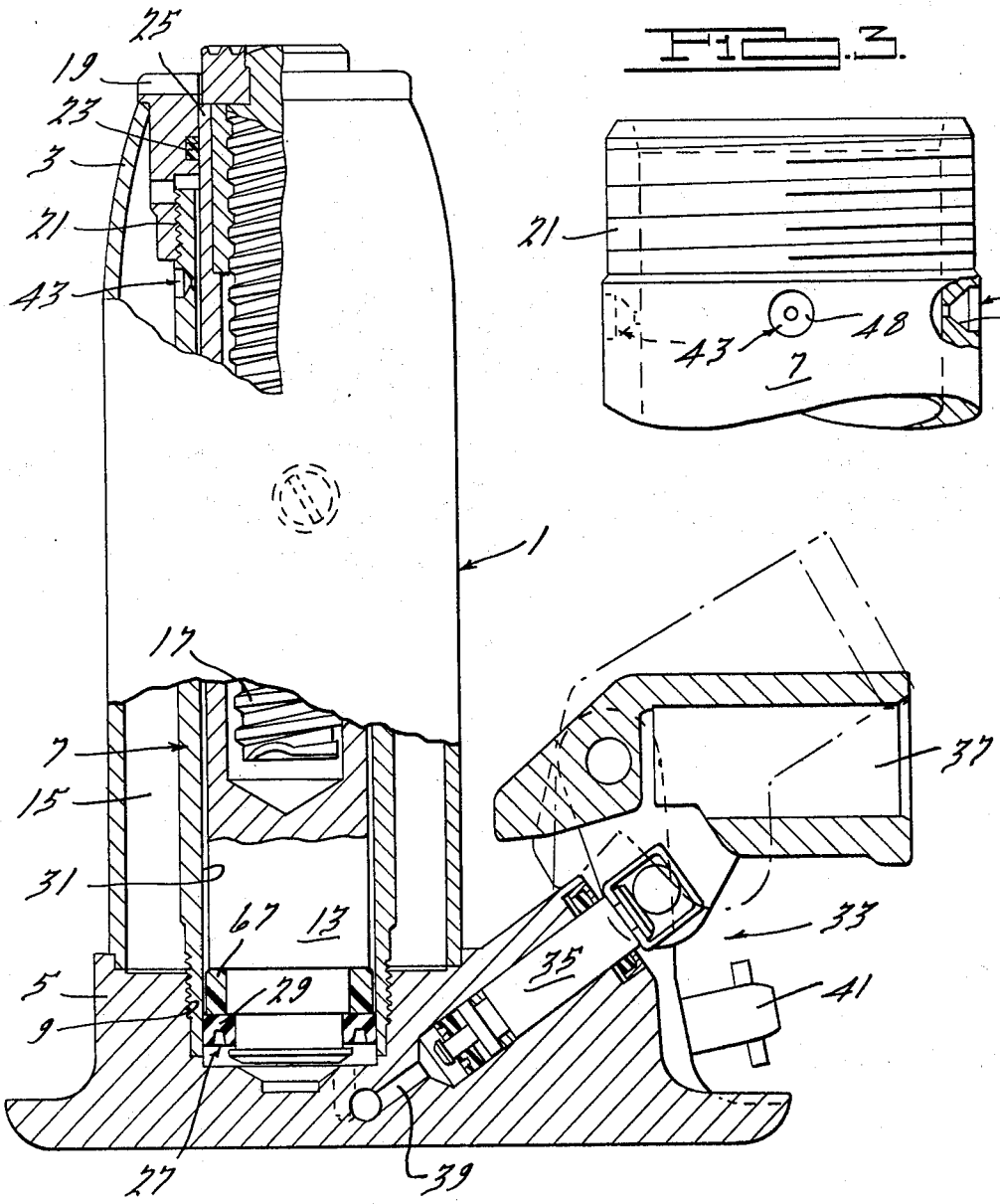
FIG. 1 is a side elevation, partly in section, of a hydraulic jack embodying the invention.

The hydraulic ram device 1 is in the form of a jack commonly used in the automotive field and has an outer cylindrical housing 3 which is supported on a base 5. Coaxially disposed inside of the cylinder 3 is a ram cylinder 7 that is threaded into the base 5 as seen at 9. The space inside cylinder 7 forms a chamber for the reciprocating ram 13 and the annular space between the cylinders 3 and 7 forms a reservoir 15 for hydraulic fluid. An extension screw 17 threads into the ram 13 from the top thereof and serves to provide a simple means to manually extend the useful height of the ram and jack. The top ends of the cylinders 3 and 7 are united by a tank nut 19 which is threadedly attached at 21 to the inner cylinder 7. The nut 19 and the top end of the cylinder 7 contain a suitable gland and packing structure 23 to prevent hydraulic leakage and support vertical sliding of the top end 25 of the ram 13.

The bottom end of the ram 13 carries a bearing and packing structure 27 (to be more fully described hereinafter) including a flexible lip packing member 29 that slides up and down the inside wall 31 of the ram cylinder 7. A suitable pump and valve mechanism 33 is provided in base 5 to furnish and release hydraulic pressure on the ram and includes a pump device 35 that is operated by handle means 37 and suitable valves and passages 39. These enable hydraulic liquid to be taken from reservoir 15 and supplied at high pressure to the bottom of packing 29 thereby causing the ram 13 to move upwardly out of the cylinder 7. A release valve 41 in the base 5 permits the operator to connect the pressure side of the ram directly to the reservoir 15 so that the ram may be lowered at the desired rate.

The power stroke or upper limit of travel of ram 13 is controlled by "weep" holes 43 in cylinder 7. Preferably four weep holes are used in equal circumferentially spaced positions around the top portion of the cylinder, just below its threaded connection 21 with the tank nut 19. When the packing 29 passes the weep holes the pressure side of the ram is connected directly to the reservoir 15 through the holes so that the upper limit of ram travel is reached. In the past these holes have been drilled through the cylinder wall and the inside edge has been sharp and therefore damaging to the relatively soft packing material, a condition materially aggravated by the high pressure which extrudes the soft packing into the holes. Since the inside edges of the weep holes are on the inside of the cylinder there has been no practical way to round them off using conventional machining techniques.

In accordance with the present invention, the holes 43 are formed or "drilled" by laser beams. The result of this technique is the formation of a rounded inner edge 45 (FIG. 4) that minimizes cutting and abrasion of the packing 29. In using the laser beam, which penetrates from the outside to the inside diameter, it appears that the air adjacent inner wall 31 drives the generated heat back into the metal (steel) at the edge of the hole and the metal which is molten from the heat of the beam forms a smooth, rounded edge due to its own cohesiveness. Thus, the inner corner edge of the hole is characterized as being a smooth, rounded, solidified molten metal shape instead of a sharp, machined or mechanically drilled shape.

Figure 4:
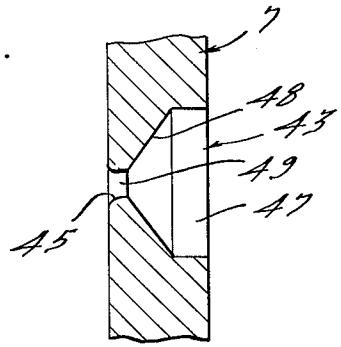
FIG. 4 is an enlarged sectional view of a part of the wall of the cylinder of FIG. 3 to show the laser hole.
Figure 5:
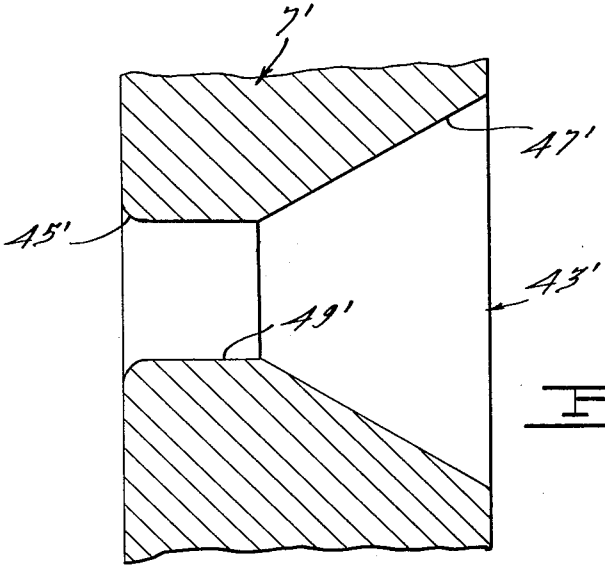
FIG. 5 is a view similar to FIG. 4 of a different passage shape.

As seen best in FIGS. 4 and 5, the hole 43 has an outer large diameter outlet portion 47 with a conical inner end 48 and an inner, uniform diameter small inlet portion 49, the edge 45 being at the inner end of portion 49. In modified hole 43' (FIG. 5) for wall 7' the entire outer portion 47' is substantially conical and the inner, small portion 49' is substantially the same as passage 49.

In forming the holes 43 or 43' in a steel cylinder 7 of about 1.750 inch outer diameter and 1.444 inch inner diameter, the enlarged portions 47 or 47' are drilled as a first operation. Thereafter, the laser beam is used to pierce the section 49 or 49'. The length of the portions 49 and 49' is preferably about 0.025 inch to 0.035 inch and the diameter is preferably about 0.01 inch, the predrilled portions 47 and 47' preferably being about 0.250 inch diameter. A standard pulsed ruby laser of about 20 joules capacity can be used. One or two pulses of the beam are sufficient to produce and then size the hole. The pulse duration is about 2 milliseconds. With this arrangement, only one partial wall thickness is pierced, i.e., the opposite side of the cylinder 7 or 7' is not penetrated from the inside out. In drilling the holes 47 or 47' it is desirable to hold the web thickness between the bottom of the hole and the surface of wall 31 within about +.005 inch to provide the laser beam with a fairly consistent wall thickness to pierce.

As seen best in FIG. 2, the packing 27 fits on a machined reduced diameter portion at the bottom of the ram 13, this portion including a first section 51 and a second and smaller section 53. The section 51 forms an annular radial shoulder 55 with the main part of the ram and the section 53 forms an annular radial shoulder 57 with the section 51, shoulders 55 and 57 both facing the bottom of the ram. The bottom end of the ram has an annular radial enlargement or flange 59, which is conically shaped on the end as seen at 61, and which provides an annular radial shoulder 63 facing the top of the ram. The shoulders 63 and 57 and section 53 define a machined groove or seat for the inverted substantially U-shaped flexible packing cup 29. An annular heel plate 67, which is preferably made of a non-metallic material, such as "NYLON" or the equivalent, is fitted on section 51 to axially contact shoulder 55 and the base of the cup 29, the heel plate 67 being slightly larger in diameter than the ram 13, chamfered on its upper outer corner 69, and somewhat smaller in diameter than the cup 29.

The flexible packing 29 is preferably shaped as shown in FIG. 2 and formed of a material that has a memory, i.e., elasticity, so that it can be stretched over the flange 59, the conical shape 61 facilitating such enlargement. Upon passing the flange 59, the packing returns to its original size and shape and is properly mounted and held in its seat. This construction eliminates a nut, washer, and threading operation on the end of the ram which has heretofore been used since leather packings were required to give maximum durability against the machining effect of sharp edged drill weep holes. The laser formed weep holes 43 of the present invention with their rounded edges 45 drastically reduce or substantially eliminate packing deterioration due to the weep holes and consequently a man-made or synthetic homogeneous packing material with a memory, such as urethane (e.g. "TEXIN" of Mobay Chemical Company), can be used for the cup 29. In addition to the economies provided, this material is actually a better packing than leather.

Figure 6:
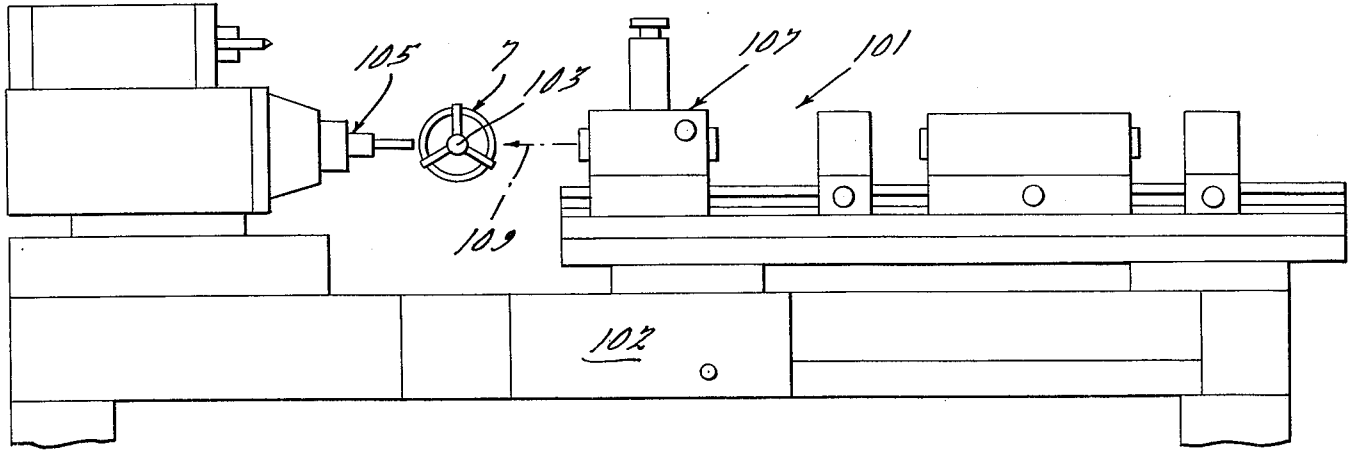
FIG. 6 is a side elevation of apparatus to form the laser passage.

FIG. 6 illustrates equipment 101 that may be used to form holes 43 or 43′ in cylinder 7 or 7′. It is of the manual type but it will be appreciated that automatic or semi-automatic equipment can be used if desired. The equipment includes a suitable frame or stand 102 on which the various parts are mounted including an indexable clamp or chuck 103 to support the cylinder 7 so that its axis is horizontal and aligned with the axis of a drill 105. The drill may be moved axially to drill the enlarged holes 47 or 47′. The cylinder is indexed the desired angular amount (preferably 90°) after each drilling operation until all the desired holes are drilled. During this stage or later, as desired, the laser beam device 107 can be actuated as previously described to produce laser beam 109 to form holes 49 or 49′ at the bottoms of holes 47 or 47′. Thus, rapid manufacture of holes 43 of desirable characteristics is achieved.

We claim:

1. In a hydraulic ram device having a reservoir, a metal cylinder having a wall and the inside of the cylinder defining a ram chamber, a ram in said chamber having a pressure end and an annular synthetic elastomer packing mounted thereon and sliding on said wall, said wall having a straight ram stroke limiting passage therein extending transversely through the thickness of the wall and opening at an inlet end into said ram chamber, said passage being traversed by said packing during a maximum power stroke of the ram, an outlet end of the passage being open to said reservoir, said passage having a laser produced short small diameter portion terminating in said inlet end and a large diameter portion terminating in said outlet end, said inlet being located adjacent the position occupied by the pressure end of the ram when the ram has moved to substantially the desired termination point for ram travel, said inlet end including an annular corner edge of said small diameter portion of said passage and said edge being characterized by being a smooth, rounded, solidified molten metal shape as a result of said smaller diameter portion being formed by a laser beam directed from the outside toward the inside of the cylinder the pressure end of said ram having a reduced diameter portion forming an annular seat coaxial with the ram and defined by an integral annular radial shoulder formed on the pressure end and in the metal of the ram, said packing being seated on said seat and having an inner diameter normally smaller than the outer diameter of the radial shoulder whereby the packing must be radially enlarged and telescoped over said radial shoulder in order to assemble it on said seat.

2. In the method of making a hydraulic ram device, the steps comprising drilling a hole to form an outer portion only of a stroke limiting passage in the wall of a metal cylinder in a manner that leaves a thin web of metal between the bottom of the hole and the inside surface of the cylinder, forming an inner end portion of said passage so that it is smaller in diameter than the outer portion by means of a laser beam directed radially inwardly with respect to the cylinder and which passes through said outer portion and which is energized to penetrate only through said web but not through the diametrically opposite portion of the cylinder wall to form a smooth rounded solidified molten metal inside edge on said inner portion of said passage, stretching a synthetic elastic annular flexible packing over the pressure end of a ram and positioning it on a seat on the ram, assembling said cylinder with other parts of said ram device including slidably inserting said ram with said packing into the cylinder so that the packing is slidable over said inside edge of the passage.

3. In a hydraulic ram device having a reservoir, a metal cylinder having a wall and the inside of the cylinder wall defining a ram chamber, a ram in said chamber having a pressure end and having an annular synthetic packing mounted adjacent said pressure end and sliding on said wall, said wall having a straight ram stroke limiting passage therein extending transversely through the thickness of the wall and opening at its inlet end into said ram chamber, said passage being traversed by said packing during a maximum power stroke of the ram, said passage having an outlet end opening into said reservoir, said passage having an inlet located adjacent the position occupied by the pressure end of the ram when the ram has moved to substantially the desired termination point for ram travel, said inlet end including an annular corner edge formed in said wall and characterized by being a smooth, rounded shape, said packing being substantially U-shaped with the legs of the U extending substantially parallel to the length of the ram and the U facing the pressure end of the ram, the pressure end of the ram having a reduced diameter portion forming an annular seat coaxial with the ram and defined at the outer end by an integral annular radial shoulder formed on and in the metal of the ram, said synthetic packing being seated on said seat and having an inner diameter normally smaller than the outer diameter of the outer shoulder whereby the packing must be radially enlarged and telescoped over said radial shoulder in order to be assembled on said seat said passage having a short small diameter portion terminating in said inlet end and a large diameter portion terminating in said outlet end, said short small diameter portion being formed by a laser beam directed from the outside toward the inside of the cylinder so that said annular corner edge is characterized by being smooth, rounded, and solidified molten metal.

* * * * *